US007867576B2

(12) United States Patent
Levin et al.

(10) Patent No.: US 7,867,576 B2
(45) Date of Patent: Jan. 11, 2011

(54) METHOD AND APPARATUS FOR MONITORING A PATTERN OF AN APPLIED LIQUID

(76) Inventors: Leonard Levin, c/o Schweitzer Cornman Gross & Bondell LLP, 292 Madison Ave., 19th Floor, New York, NY (US) 10017; Sophia Levin, c/o Schweitzer Cornman Gross & Bondell LLP, 292 Madison Ave., 19th Floor, New York, NY (US) 10017

( * ) Notice: Subject to any disclaimer, the term of this patent is extended or adjusted under 35 U.S.C. 154(b) by 1303 days.

(21) Appl. No.: 11/194,423

(22) Filed: Aug. 1, 2005

(65) Prior Publication Data

US 2007/0026133 A1 Feb. 1, 2007

(51) Int. Cl.
*B05C 11/00* (2006.01)

(52) U.S. Cl. ..... 427/427.2; 118/677; 118/679; 118/682; 118/684; 118/692

(58) Field of Classification Search ..... 118/677, 118/679, 682, 684, 692; 427/8, 424, 427.2
See application file for complete search history.

(56) References Cited

U.S. PATENT DOCUMENTS 6,770,142 B2 8/2004 Estelle

2006/0096530 A1* 5/2006 Klein ..... 118/665

OTHER PUBLICATIONS

Nordson Corporation, "Seal Sentry Series 10 Bead Detection System", 6 pages, Jul. 2003.

ITW Dyna Tec, "DY 2008 Pattern Controller", 2 pages, date unknown.

Nordson Corporation, "Seal Sentry Series 10 Bead Detection System", 2 pages, Jan. 2001.

* cited by examiner

*Primary Examiner*—George R Koch, III
(74) *Attorney, Agent, or Firm*—Ladas & Parry LLP

(57) ABSTRACT

A method for monitoring the quality of a pattern of fluid beads applied to a moving substrate measures time delays between the passage of a reference point on a substrate element and leading and trailing edges of a bead, the quality of which is to be measured. A time delay ratio is generated, and compared to a reference ratio. The result of the comparison is indicative of variations in the quality of the measured bead. The invention has utility in a variety of industries, including industries in which adhesive beads are applied to a substrate, such as the envelope and box industries. An apparatus in accordance with the invention may conveniently utilize non-contact sensors to monitor the passage of the substrate and beads, and further may advantageously monitor the leading edge of the substrate and leading and trailing edges of the beads.

13 Claims, 3 Drawing Sheets

METHOD AND APPARATUS FOR MONITORING A PATTERN OF AN APPLIED LIQUID

The present invention relates generally to fluid dispensing systems for dispensing flowable material, such as adhesive, sealants, caulks and the like, onto a substrate, and more particularly to an apparatus and method for monitoring the pattern of an applied fluid obtained from an operation of a fluid dispensing system.

BACKGROUND OF THE INVENTION

The ability to have a desired pattern of a fluid, for example an adhesive, on a substrate is a necessity for manufacturers engaged in a variety of industries, including the packaging and plastics industries. A typical process to obtain a pattern of a fluid on a substrate is found in the packaging industry, and employs a dispensing device in the form of an adhesive gun to apply adhesive onto a substrate being moved past the dispensing device, for example, by a conveyor. A fluid dispensing system monitors conveyor movement and movement of the substrate to provide the adhesive gun with dispensing command signals.

The quality of the adhesive dispensing process is a subject to many variables that include general environmental conditions, the physical state of the adhesive being dispensed, the physical condition of the dispensing device, and the stability of other system parameters. Changes in such variables often result in variations in the operation of the dispensing device that in turn can produce variations from the desired pattern of the adhesive fluid on the substrate.

There are known devices for detecting and monitoring the placement of the pattern of a liquid, such as an adhesive dispersed by a fluid dispensing system onto a moving substrate. Some systems attempt to monitor the presence and location of adhesive on the substrate by measuring delays between dispensing gun activation and deactivation signals and signals representing leading and trailing edges of the applied adhesive, calculating a correlation between those signals, and evaluating the correlation through a statistical processing method. While such systems can effectively monitor the quality of a pattern of a fluid, those systems are not capable of monitoring a pattern of a fluid without utilizing dispensing gun activation and deactivation signals generated by a fluid dispensing system. Thus, they require a sophisticated interface with the dispensing system. Such systems are further limited to fluid dispensing systems employing an adhesive gun and are not applicable to fluid dispensing systems using other types of dispensing devices, such as a gum box.

Other systems for testing or monitoring the quality of the pattern of an applied fluid sense an edge of an adhesive bead within a programmed window within which the edge of the bead is predicted to occur. Some of such systems require that the bead adhesive pattern that is programmed into the fluid dispersing system also be programmed into the monitoring system, while the motion of the conveyor for the substrate to which the fluid pattern is applied be monitored by a conveyor motion sensor coupled to the conveyor. Thus, these systems require both a highly skilled technician to perform the programming and the presence of a conveyor motion sensor.

Some other systems acquire a sample fluid pattern by sampling a pattern of the fluid, the quality of which is satisfactory and then evaluating subsequent patterns by comparing time delays for leading and trailing edges of the beads of the sampled pattern with corresponding time delays extracted from the subsequent pattern. While such systems simplify the acquisition of the reference pattern data, the use of time delays as a measure for sensing the edges of the beads for comparison with the reference pattern limits the application of such systems to the monitoring of patterns of a fluid on substrates that travel with a constant line speed with respect to the dispensing and sensing devices, and requires the selection of new reference data and the associated recalibration of the system with every speed change.

There is accordingly a need for a fluid pattern monitoring system that effectively and reliably detects and monitors the quality of a pattern of a fluid applied by a fluid dispensing system that is applicable to a variety of dispensing devices applying the fluid to substrates moving with variable speeds with respect to the fluid dispensing device, and which operates independently from the fluid dispensing system, and is relatively easy and efficient in setup, calibration and maintenance.

BRIEF SUMMARY OF THE INVENTION

In accordance with the foregoing and other purposes and objects, a monitoring apparatus in accordance with the present invention computes time differences associated with the sensing of a particular substrate location and leading and trailing edges of one or more fluid beads applied to the substrate to be monitored. These time differences are used to develop dimensionless ratio values, which are compared to corresponding ratios developed from a sample or reference pattern. As the ratios are dimensionless, their numerical values are not speed-dependent, and thus are applicable at any line speed for a given pattern.

The monitoring system of the present invention permits the dispensing of adhesive or other liquids onto a moving substrate to be accurately and continuously tracked without a complicated interface with the dispensing circuitry. By accurately computing delay ratios and comparing them with the corresponding delay ratios extracted from the sample pattern, the monitoring system provides information for a variety of quality control processes.

The diagnostic monitoring apparatus of the present invention can be used with different types of fluid dispensing systems, is inexpensive, is easy to install and to use, requires little user setup or maintenance and is very reliable. The diagnostic monitoring of the apparatus of the present invention is especially useful in adhesive dispensing applications in which complex patterns of an adhesive are being dispensed by fluid dispensing systems that otherwise are without the capability to evaluate the quality of the adhesive dispensing process, as the apparatus can be added or retrofitted to a dispensing system without substantial invasion of the system's integrity.

A second aspect of the invention comprises a method for monitoring the quality of a liquid pattern applied to a substrate. The times of passage past reference points of a designated location on a substrate and of designated locations on one or more applied fluid beads applied to the substrate are recorded and utilized to generate difference values, each difference value representing a delay or time difference between the time passage of the designated substrate location and one of the designated bead locations. A ratio between the two difference values for each bead is then computed. The ratio is compared to a corresponding ratio obtained from a reference pattern. The results of the comparisons are used as an input to a quality control monitor.

The designated location on the substrate is preferably the leading edge of the substrate, such as an envelope blank, while the designated locations on the fluid bead are preferably leading and trailing edges.

BRIEF DESCRIPTION OF THE DRAWINGS

A fuller understanding of the invention will be achieved upon consideration of the following detailed description of a preferred, but nonetheless illustrative embodiment, when reviewed in association with the annexed drawings, wherein.

DETAILED DESCRIPTION OF THE INVENTION

The monitoring system of the present invention utilizes a measurement of time differences or delays between the sensing of a signal representing a particular location, such as an edge of a substrate, and the sensing of signals representing particular locations, such as the leading and trailing edges, of a fluid bead forming a pattern of a fluid dispensed on the substrate; a computation of a ratio between the leading edge delay and the trailing edge delay for each adhesive bead in the fluid pattern, a selection, by the user, of a sample or reference fluid pattern; storage of the computed ratios for the sample pattern; and monitoring the quality of the patterns of the fluid by comparison of the ratios for a pattern under evaluation with the ratios for the sample pattern. The results of the comparison are used for pattern quality monitoring purposes.

Figure 1:
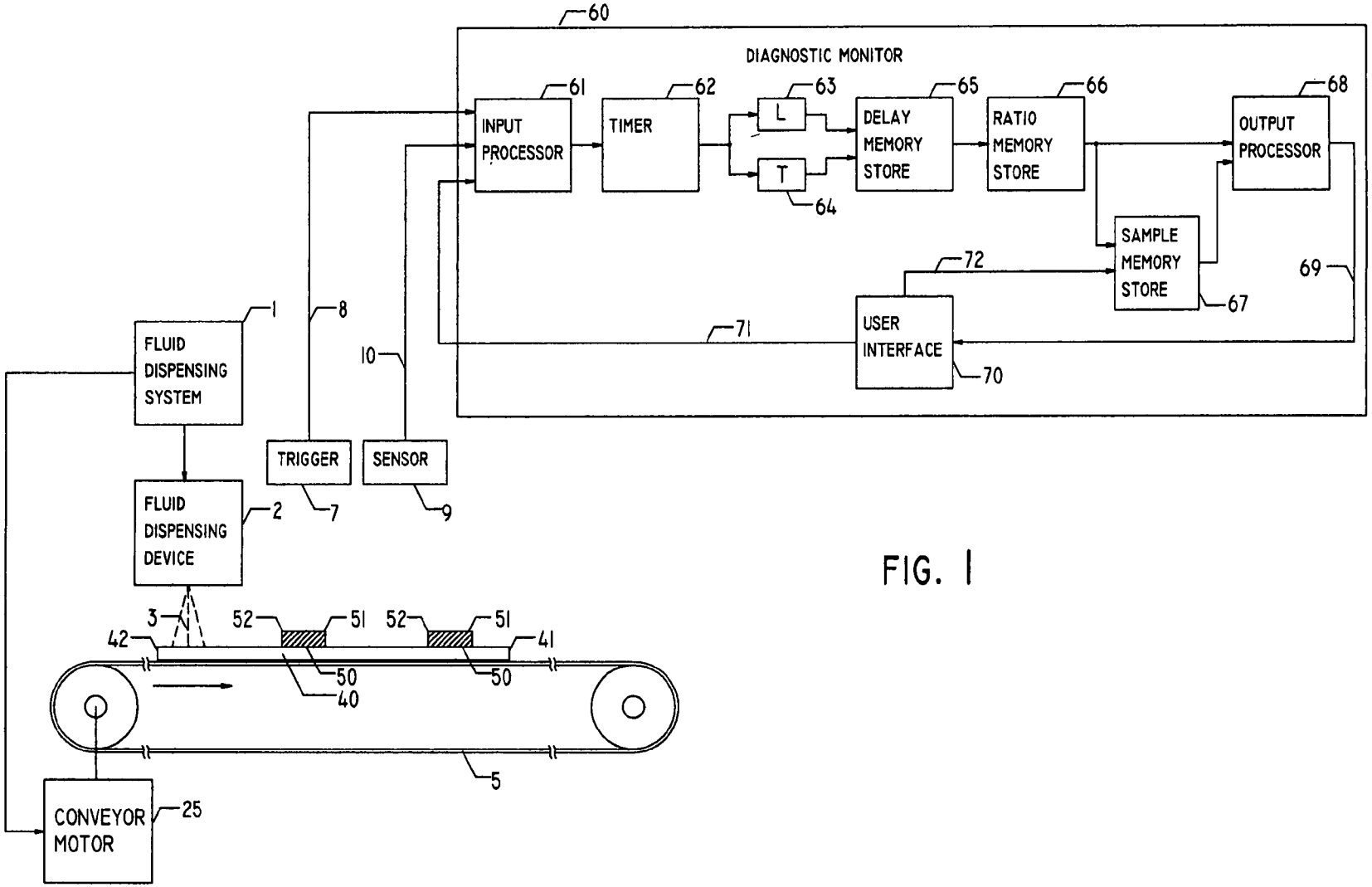
FIG. 1 is a schematic block diagram of a diagnostic monitor for use with a fluid dispensing system in accordance with the principles of the invention.

Referring to FIG. 1, a diagnostic monitor 60 in accordance with the invention detects the quality of a pattern of a fluid dispensed by a fluid dispensing system 1. The fluid dispensing system I comprises a fluid dispensing device 2 that dispenses a fluid 3, for example, an adhesive, onto a substrate element 40, such as an envelope blank. The substrate 40 is carried by conveyor 5 past the fluid dispensing device. The conveyor 5 is mechanically coupled to a conveyor drive having a conveyor motor 25. The fluid dispensing system 1 controls the operation and speed of the conveyor motor 25 and the operation of the fluid dispensing device 2 as known in the art. A pattern of the fluid formed on the substrate 40 as the substrate 40 passes the fluid dispensing device 2 comprises one or more adhesive beads 50 deposited on the substrate 40.

The diagnostic monitor 60 includes an input processor 61, a timer 62, memory cells 63 and 64, memory stores 65, 66 and 67, output processor 68, and user interface 70. The diagnostic monitor 60 provides output data or signals 69 representing the results of a comparison between the ratios of measured delays derived from an evaluated fluid pattern, stored in the ratio memory store 66, with corresponding ratios of measured delays derived from a sample or reference fluid pattern, stored in the sample memory store 67. As known in the art, the operation of diagnostic monitors can be implemented by a suitably programmed micro-processor system.

The first component of the ratio of measured delays is the delay from the sensing of leading edge 41 of substrate 40 sensed by a trigger sensor 7 to the time when a leading edge 51 of an applied adhesive bead 50 is detected by sensor 9. The second component of the ratio of measured delays represents the delay from the sensing of the leading edge 41 of the substrate 40 sensed by trigger sensor 7 to the time when a trailing edge 52 of the adhesive bead 50 is detected by a sensor 9. It is to be appreciated that the position of the pattern of the adhesive (or other fluid) dispensed on the substrate 40 carried by conveyor 5 can be described by the unique ratios of measured delays associated with each adhesive (or other fluid) pattern bead 50, which ratios will be constant for any conveyor speed, exception the time of conveyor accelerations or decelerations. Variations in the output 69 in diagnostic monitor 60 reflect variations in the ratios of measured delays from one substrate unit to another and are indicative of a difference in the applied pattern of fluid from one substrate to another. When one of the ratio sets is derived from a control or reference pattern, the output 69 can be used to continuously track the quality of the adhesive dispensing process.

The input processor 61 detects the movement of the substrate 40 on the conveyor 5 by processing trigger signal 8 received from trigger sensor 7. The trigger sensor 7 is mounted with respect to the conveyor 5 such that the trigger sensor 7 can sense the leading and trailing edges 41, 42, respectively of the substrate 40 as the substrate 40 moves on the conveyor 5. The trigger signal 8 changes as the edges of substrate 40 pass the trigger sensor 7. The trigger sensor 7 is any sensor capable of reliably detecting the leading and trailing edges, and may be, for example, a proximity sensor, an optical sensor, or the like as known in the art.

The input processor 61 also detects each adhesive bead of the fluid pattern dispensed on the substrate 40 by the fluid dispensing device 2 by processing the sensor signal 10 received from the sensor 9. The sensor 9 is mounted with respect to the conveyor 5 such that the sensor can sense the leading and trailing edges 51, 52, respectively of the adhesive beads 50 dispensed onto the substrate 40. The sensor signal 10 changes as the adhesive bead edges pass the sensor 9. The sensor 9 is any sensor capable of reliably detecting the leading and trailing edges and may be, for example, an infrared sensor, laser sensor, UV sensor, or the like, as known in the art.

Figure 2:
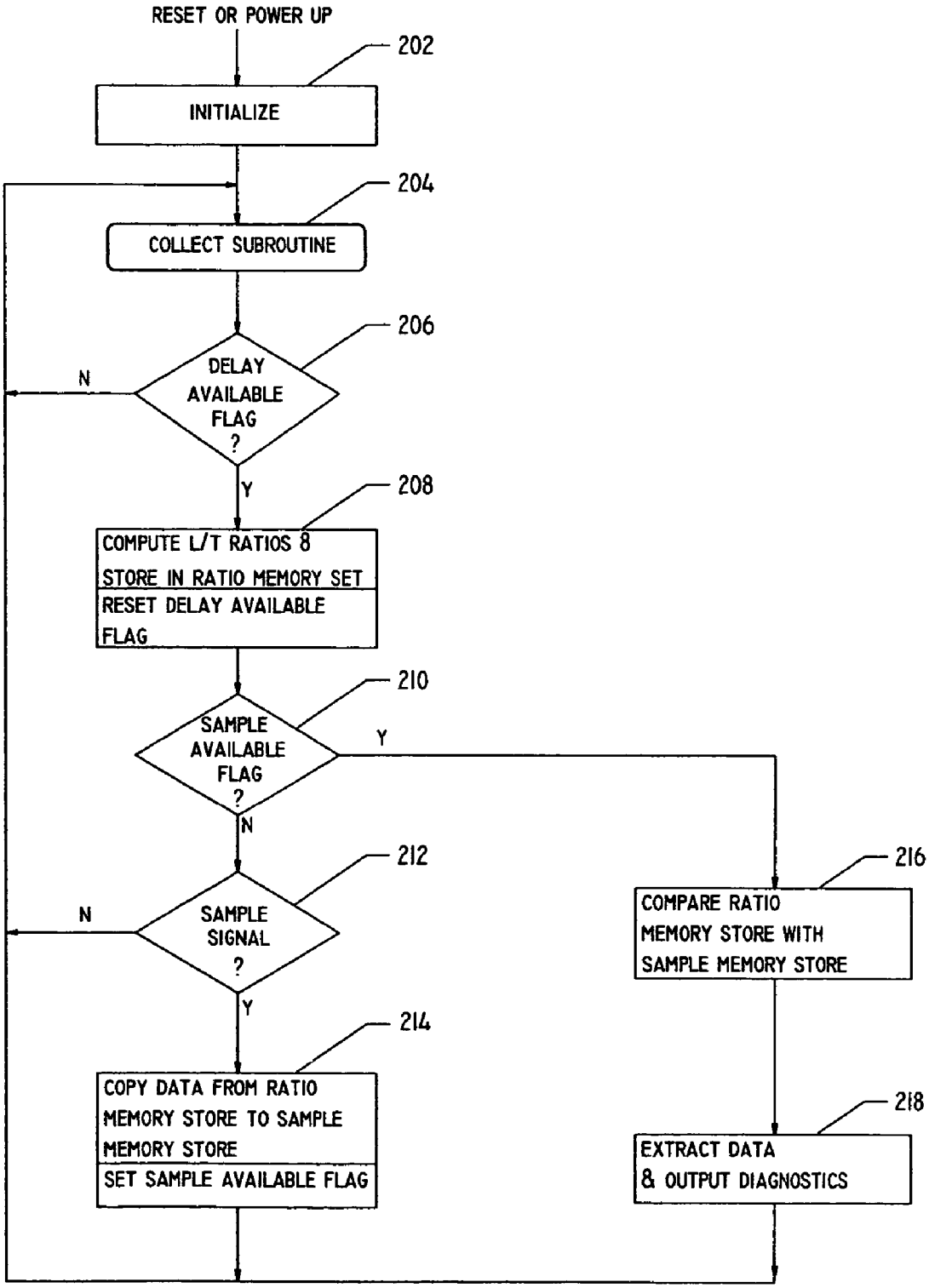
FIG. 2 is a flowchart of operation of the diagnostic monitor of FIG. 1.

Operation of the diagnostic monitor 60 is exemplified by the procedure shown in the flowchart diagram of FIG. 2. Upon detecting a reset or power up signal, the diagnostic monitor at 202 initializes the system by clearing a trigger flag, a sensor flag, a delay available flag and a sample available flag. A collect subroutine is then carried out at 204, in which the diagnostic monitor 60 determines a leading edge time delay L and a trailing edge time delay T for each adhesive bead 50 comprising the dispensed fluid pattern to be monitored. The leading edge time delay L reflects the delay between the occurrence of the leading edge of a trigger signal (representing the leading edge of the substrate) and the occurrence of a sensor signal leading edge (representing the leading edge of the bead). The trailing time delay T reflects a delay between the occurrence of the trigger signal leading edge and the occurrence of a sensor signal trailing edge (representing the trailing edge of the bead). Diagnostic monitor 60 collects L and T time delays for each adhesive bead and stores them as pairs in a delay data set located in delay memory store 65.

Figure 3:
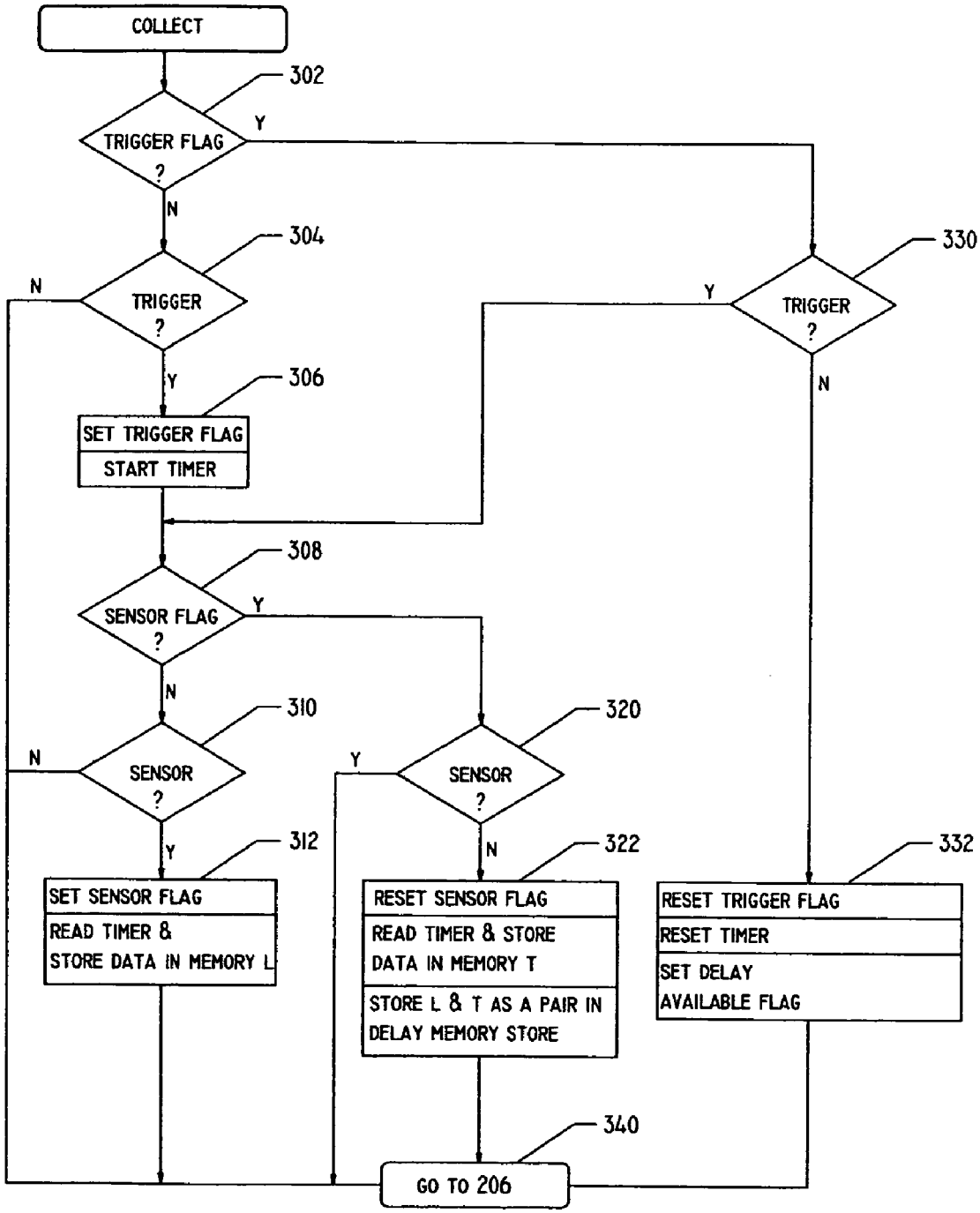
FIG. 3 is a flowchart of a collect subroutine used in the process set forth in FIG. 2.

The process of collecting and storing the L and T time delays is further illustrated in FIG. 3. The existence of a trigger flag indicates that input signal processor 61 has previously detected the onset of a trigger signal, and that the signal is continuing. Thus, it indicates that the leading edge of the substrate has been detected; it remains set until the substrate trailing edge is detected. The status of the trigger flag is monitored at 302, while branches 304 and 330 jointly insure that data collection occurs only during the time interval that a trigger signal is present.

When a substrate element is first sensed processing passes to 304. The onset of the trigger signal corresponding to the sensing of the leading edge of a substrate is recognized, and the trigger flag is set and a delay timer initiated at 306. Alternatively, if the trigger flag was previously set, processing branches at 302 to 330, which looks for the ending of the trigger signal, signifying the trailing end of the substrate. When the trailing edge is sensed, step 332 is performed, resetting the trigger flag and timer, and setting the delay available flag which is used to indicate that data capture for a substrate segment has been completed. If the trigger flag remains present, control is passed to block 308.

Continuing along the left pathway in FIG. 3, once the trigger flag is set and the timer starts at 306, or the trigger was previously set and remains on the system determines at 308 whether the sensor flag has been set, denoting that the leading edge of a bead has previously been detected. Upon startup the sensor flag is reset, and the system looks for the receipt of a sensor output at 310, indicating the leading edge of a bead. When the leading edge is recognized, the sensor flag is set and a timer value is read and stored in memory cell L at 312.

If the sensor flag has been previously set, the procedure branches at 308 to step 320, which monitors the continued presence of the sensor signal, signifying the continued presence of a bead. When the end of the sensor signal is reached, signifying the trailing edge of the bead, the sensor flag is reset, and the current timer value is read and stored in memory cell T at 322. The timer values in storage L and T are stored as a pair, representing the leading and trailing edge delays for the bead.

Once the trigger flag is set and a trigger signal is present, the collect routine continues to loop to await the onset of a sensing of a bead. Once the leading edge of a bead has been sensed, the routine loops to await the sensing of a bead trailing edge. When either the trailing edge of the substrate or the trailing edge of a bead is sensed, the collect routine is exited at 340, and control passes to step 206 in FIG. 2.

When the sensor flag is cleared at 322, the collect routine is exited at 340 to check for the delay available flag at 206 in FIG. 2, indicating that the substrate trailing edge has been reached. If it has not been reached, the collect routine is re-entered to continue to await the end of a trigger signal. If prior to the change of the trigger state sensed at 330 a second liquid bead is sensed, its presence will be noted at 310, resetting the sensor flag at 312, and the timer data associated with the leading edge is read and stored. The system then awaits the trailing edge of the new bead. When the trailing edge of the substrate is sensed at 330, the trigger flag is reset, the timer is reset, and the delay available flag is set, providing an indication to the system that all bead data associated with the substrate element has been received. The collect routine then awaits the onset of a new substrate element.

Referring again to FIG. 2, when the diagnostic monitor 60 detects, at 206, the delay memory store available flag, the monitor computes, at 208, the ratio L/T for each data pair in delay memory store 65 and stores the results in the ratio memory store 66. The delay available flag is then reset. At step 210 the diagnostic monitor then evaluates the sample available flag to determine whether the sample memory store has data to allow for the execution of the comparison process between the computed ratios and stored sample or reference ratio values. If the sample available flag is not set, the diagnostic monitor checks, at step 212, for the presence of a sample signal 72, which is set by the user when the user is satisfied with quality of the dispensed pattern through the user interface 70. If the sample signal is present, the diagnostic monitor proceeds to step 214, where the data from the ratio memory store is copied into the sample memory store 67 and the sample available flag is set, signifying that the copied data is to be used as the sample or reference. The collect routine is then re-entered at 204.

Upon the collection of the next set of data, the diagnostic monitor 60 will detect, at step 210, the set status of the sample available flag, and proceeds to step 216, where the output processor 68 compares the contents of the ratio memory store 66 with the contents of the sample memory store 67. Upon detecting a variation between any of the ratios, the degree of which can be chosen by the user, the output processor 68, at step 218, generates an output signal 69. The output signal 69 is processed at 218 to generate, for example, an alarm signal to the user through the user interface 70 in the form of an audible sound, a light, a message display or other sensory perceptible presentation. The user can then take the steps necessary to evaluate and correct the problem.

Upon the sensing of a reset signal 71 by the input processor 61, the diagnostic monitor 60 stops the pattern evaluation, resets all flags, and resumes the evaluation once the input processor 61 senses a new sample signal 72. The user through user interface 70 originates the reset signal 71, and can instruct the system to retain the previously-stored sample data on reset for further use, if desired.

By use of delay ratios to identify the pattern of an applied fluid, the diagnostic monitor 60 does not require a signal from a conveyor motion sensor to track the movement of the substrate on the conveyor, and can be used when the conveyor moves with variable speeds at different processing intervals. Further, by comparing the ratios of delays received directly from the pattern of a fluid that is selected by the user to serve as a sample pattern with the ratios of delays received from an evaluated pattern, the diagnostic monitor 60 does not require information about a desired pattern of a fluid and the signals for controlling the dispensing device to evaluate the pattern of a fluid. Thus, the monitor can be used for quality control of the dispensing of adhesive for a wide variety of fluid-dispensing systems with electrical, pneumatic, etc., fluid-dispensing devices.

The diagnostic monitor 60 is easy to implement and to use, requires little user setup or maintenance and is very reliable. Further, the diagnostic monitor is especially useful in existing adhesive and other fluid dispensing applications to provide quality control for dispensing patterns without any disturbance to the existing fluid dispensing system.

While the present invention has been illustrated and described in connection with a preferred embodiment, one skilled in the art will comprehend that other embodiments and modifications to the intention as described may be achieved without departing from the scope of the invention. For example, the diagnostic monitor 60 of the present invention can use the ratio of delays where the delays are measured as the amounts of fixed, narrow-width pulses generated by a pulse generator and counted by a counter. Further, the diagnostic monitor 60 can be implemented in hardware or software using digital, analog or combination of digital and analog signals and processing. For example, the trigger signal 6 may be a digital signal, and the sensor signal 10 may be an analog signal. In addition, delay signals may be triggered by a variety of sensors, detecting start and stop points associated with a variety of characteristics, the positioning of which is to be monitored. For example, color responsive sensors can be used to determine leading and trailing boundaries of a color line area or border to monitor the width thereof in a multicolor image.

We claim:

1. A method for monitoring a pattern of fluid beads applied by a fluid applicator to a substrate moving with respect to the fluid applicator, comprising the steps of:

a) generating a first signal corresponding to a time of passage of a first, leading point on the substrate past a reference location;

b) generating second and third signals corresponding to a time of passage of a leading edge and a trailing edge, respectively, of a fluid pattern bead applied to the substrate past a reference location;

c) calculating a first time difference between the first signal and the second signal and a second time difference between the first signal and the third signal;

d) calculating a ratio between the first and second time differences; and e) comparing the ratio to a reference ratio and generating a signal corresponding to the results of the comparison.

2. The method of claim 1, comprising the steps of f) performing steps a through d with respect to a first substrate element to create a reference ratio; and g) performing steps a through d with respect to a second substrate element and performing step e using the reference ratio of step f.

3. The method of claim 1 wherein the number of pattern fluid beads applied to the substrate is greater than one, comprising the steps of:

performing step a and then repeating steps b through d with respect to each fluid bead of the pattern to be monitored; and comparing the ratio for each bead to a corresponding reference ratio and generating a signal corresponding to the results of the comparisons.

4. An apparatus for monitoring a pattern of fluid applied by a fluid applicator to a substrate moving with respect to the fluid applicator, comprising:

sensor means for generating a first signal corresponding to the passage of a first fixed point on the substrate associated with an applied fluid pattern and second and third signals corresponding to the passage of a leading edge and a trailing edge respectively of a bead of the applied fluid pattern past reference locations;

means utilizing the first, second and third signals to calculate a ratio corresponding to a ratio of distances between the first fixed point and the leading and trailing edges of the bead;

means for comparing the ratio to a reference ratio and generating a signal corresponding to the results of the comparison.

5. The apparatus of claim 4, further comprising means for storing the ratio derived from a reference substrate, wherein the means for comparing the ratio to a reference ratio utilizes the stored ratio as the reference ratio.

6. An apparatus for monitoring a pattern of a fluid applied by a fluid dispensing device onto a substrate moving with respect to the fluid dispensing device, wherein a trigger sensor is disposed for providing a trigger signal in response to detecting an edge of a substrate element and a sensor is disposed for providing a sensor signal in response to detecting an edge of the fluid applied to the substrate element, the apparatus comprising:

an input processor for detecting the trigger and sensor signals and providing representations of the corresponding edges of the substrate element or fluid;

a timer connected to said input processor and configured for measuring time delays between trigger signals and sensor signals associated with a substrate element;

memory cells connected to the timer for storing a first data value corresponding to a time delay between a given substrate leading edge trigger signal and a liquid leading edge sensor signal and a second data value corresponding to a time delay between the given substrate leading edge trigger signal and a liquid trailing edge sensor signal;

means connected to the timer for computing and storing a data value corresponding to a ratio between the first and second data values; and an output processor configured for comparing the data value to a reference ratio data value and generating a output signal representative of results of the comparison.

7. The apparatus of claim 6 further comprising a sample memory store for storing the reference ratio data value and means for transferring a data value corresponding to a ratio between the first and second data values associated with a chosen substrate element from the data storage means to the sample memory store.

8. The apparatus of claim 7 further comprising a user interface coupled to the output processor for identifying the reference ratio data value to be used by the output processor.

9. The apparatus of claim 8 wherein the user interface comprises means for triggering a transfer of the data value from the data storage means to the sample memory store.

10. A method of monitoring a pattern of a fluid dispensed by a fluid dispensing device on a substrate moving with respect to the fluid dispensing device, the method comprising the evaluating of quality of the pattern by comparing a ratio of delays associated with designated locations on the pattern with a corresponding ratio of delays associated with a reference pattern of the fluid.

11. The method of claim 10, wherein the delays comprise a first delay associated with a leading edge of the fluid pattern and a second delay associated with a trailing edge of the fluid pattern.

12. The method of claim 10 wherein the corresponding ratio of delays is derived from the evaluation of a sample pattern on a substrate.

13. The method of claim 11 wherein the first delay is measured as a delay between a sensing of a reference location on the substrate and the sensing of the leading edge of the fluid pattern and the second delay is measured as a delay between a sensing of a reference location on the substrate and the sensing of the trailing edge of the fluid pattern.

* * * * *